US006170174B1

(12) United States Patent
Gesso

(10) Patent No.: US 6,170,174 B1
(45) Date of Patent: Jan. 9, 2001

(54) SHOCK ABSORBING LINER FOR BASEBALL SHOE

(76) Inventor: Robert J. Gesso, 4 Country Club La., Scotch Plains, CA (US) 07076

( * ) Notice: Under 35 U.S.C. 154(b), the term of this patent shall be extended for 0 days.

(21) Appl. No.: 09/062,926

(22) Filed: Apr. 20, 1998

(51) Int. Cl.[7] ..... A43B 13/22; A43C 13/14
(52) U.S. Cl. ..... 36/72 R; 36/77 R; 36/126
(58) Field of Search ..... 36/54, 55, 93, 36/96, 102, 133, 71, 72 R, 77 R, 126

(56) References Cited

U.S. PATENT DOCUMENTS

| | | | | |
|---|---|---|---|---|
| 860,024 | | 7/1907 | Golden . | |
| 2,864,180 | | 12/1958 | Montgomery | 36/72 |
| 3,243,901 | * | 4/1966 | Clarizio | 36/72 R |
| 3,325,922 | * | 6/1967 | Bray | 36/72 R |
| 3,481,055 | | 12/1969 | Herman | 36/72 |
| 4,342,159 | * | 8/1982 | Edwards | 36/72 R |
| 4,656,761 | * | 4/1987 | Lord | 36/77 R |
| 4,967,493 | | 11/1990 | Mues | 36/72 |
| 5,566,476 | * | 10/1996 | Bertrand et al. | 36/72 R |
| 5,711,092 | * | 1/1998 | Despres et al. | 36/133 |

* cited by examiner

*Primary Examiner*—Paul T. Sewell
*Assistant Examiner*—J. Mohandesi
(74) *Attorney, Agent, or Firm*—Goldstein & Canino

(57) ABSTRACT

A shock absorbing liner to be attached to the interior of a baseball shoe to help protect the toes and upper portion of wearer's foot from injury that can occur during baseball batting. The shock absorbing liner includes a plurality of rigid protective shell members constructed of a hard plastic material that possess sufficient shock absorbing capability to resist a wide range of dynamic impact forces that may be applied to the baseball shoe by a foul tipped ball striking the shoe. The rigid protective shell members are shaped and arranged to cover and protect essentially the entire upper foot region including the toes. The rigid protective shell members are joined by bendable elements so as to allow the shock absorbing liner freedom to flex with the baseball shoe while affording foot protection.

6 Claims, 3 Drawing Sheets

SHOCK ABSORBING LINER FOR BASEBALL SHOE

BACKGROUND OF THE INVENTION

This invention relates to a shock absorbing liner to be worn inside a baseball shoe. More particularly, the invention relates to a shoe liner which may be attached to the inside of a baseball shoe for protecting the toe and upper portion of the foot without significantly restricting the normal movement of the foot. Further, the invention relates to a shock absorbing liner comprising a plurality of rigid protective shell members joined by bendable elements so as to allow it to flex with the baseball shoe as it bends.

Many baseball players injure their front batting foot when a foul tipped ball or a wild pitch strikes their foot. Accordingly, various references uncovered in the prior art provide devices that are adapted to fit over the forward part of a baseball shoe to protect the wearer's foot from foul tipped balls are known in the art. For example, U.S. Pat. No. 4,967,493 to Mues discloses a two piece protective cover attachable to the shoe of a baseball player to protect the foot from foul tipped balls, wherein a lower piece is secured to the toe of a conventional baseball shoe, and an upper piece is detachably held to the lower piece in a raised position above the top of the shoe. Likewise, U.S. Pat. No. 3,481,055 to Herman discloses a baseball shoe safety protector comprising a hollow member made of flexible plastic material which is adapted to fit over the forward part of a baseball shoe, wherein the hollow member is provided with inturned portions for engaging with the sole of the shoe and a resilient stretchable web for engaging spikes on the bottom of the shoe.

Most of these prior art devices must be worn over the baseball shoe. These devices often employ a one-piece protective structure that is relatively rigid and sufficiently large to cover the entire upper area of the foot. Wearing such a protective structure outside the shoe is undesirable not only because it can rip and tear the outside of the shoe but also because it can hinder quick movements of the athlete. For instance, in the protective cover disclosed by U.S. Pat. No. 4,967,493 to Mues, the upper piece which is attached to the top of the baseball shoe during baseball swing, must be manually detached from the shoe by the wearer just prior to base running. Therefore, there is still a further need to provide an improved shock absorbing liner for a baseball shoe. Such a shock absorbing liner should afford the necessary protection to the wearer's foot when worn inside a baseball shoe so as to minimize the danger of injury precipitated by foul tipped balls. Moreover, such a shock absorbing liner should utilize a plurality of rigid protective shell members joined by bendable elements so as to allow the shock absorbing liner freedom to flex along with the wearer's foot while still effectively shielding the foot against external impact forces.

While these units mentioned above may be suitable for the particular purpose employed, or for general use, they would not be as suitable for the purposes of the present invention as disclosed hereafter.

SUMMARY OF THE INVENTION

It is an object of the invention to provide a shock absorbing liner which is simple in construction so as to minimize manufacturing cost, and yet helps protect the toes and upper portion of the foot from injury such as bone bruises that can occur during baseball batting.

It is another object of the invention to provide a shock absorbing liner which utilizes a plurality of rigid protective shell members joined by bendable elements so as to allow the shock absorbing liner freedom to flex along with the wearer's foot while shielding the foot against external impact forces.

It is yet another object of the invention to provide a shock absorbing liner which utilizes a plurality of rigid protective shell members which are light in weight and possess sufficient shock absorbing capability to resist a wide range of dynamic impact forces that may be applied to the shoe by a foul tipped ball striking the shoe.

The invention is a shock absorbing liner to be attached to the interior of a baseball shoe to help protect the toes and upper portion of wearer's foot from injury that can occur during baseball batting. The shock absorbing liner includes a plurality of rigid protective shell members constructed of a hard plastic material that possess sufficient shock absorbing capability to resist a wide range of dynamic impact forces that may be applied to the baseball shoe by a foul tipped ball striking the shoe. The rigid protective shell members are shaped and arranged to cover and protect essentially the entire upper foot region including the toes. The rigid protective shell members are joined by bendable elements so as to allow the shock absorbing liner freedom to flex with the baseball shoe while affording foot protection.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
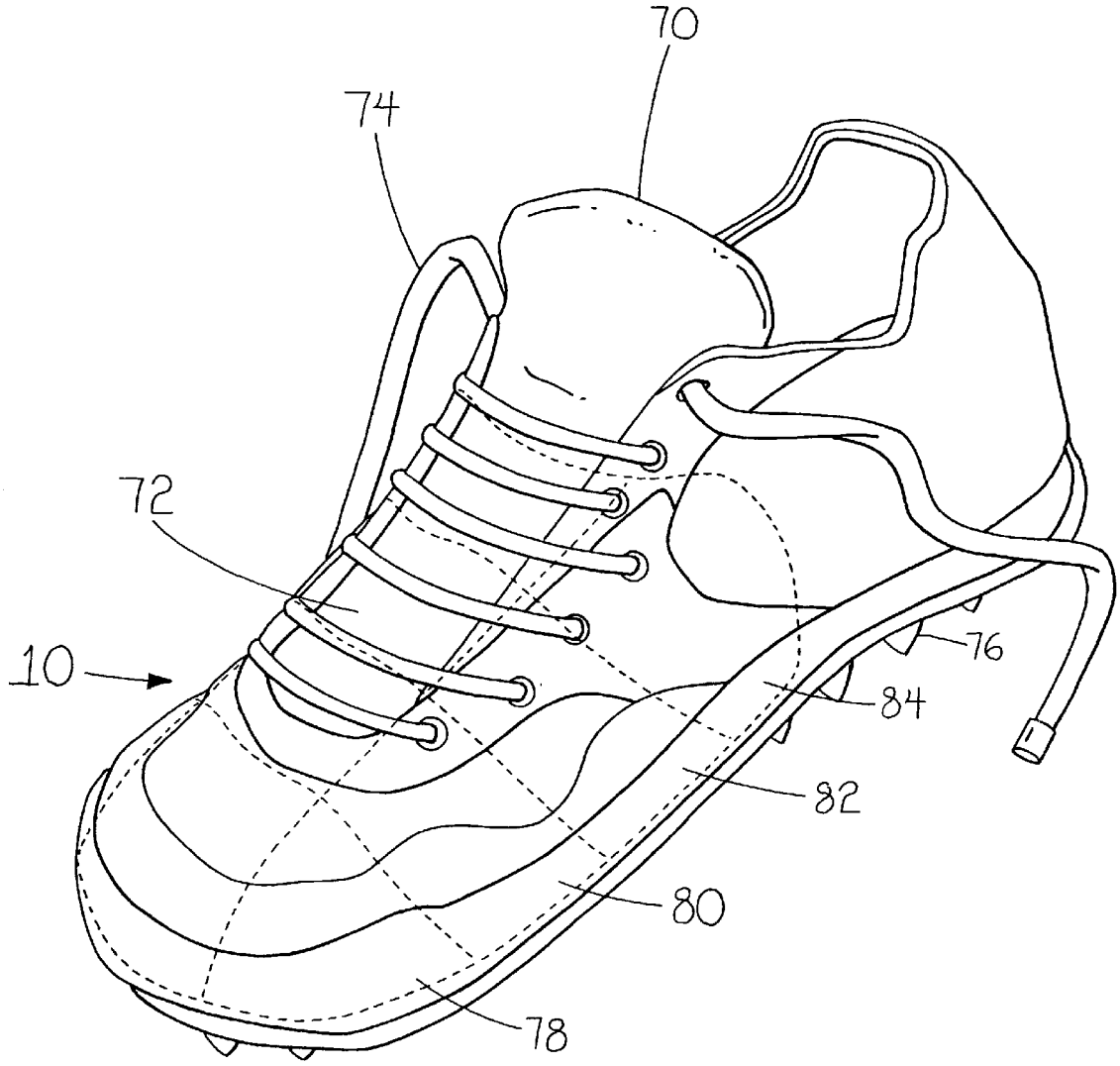
FIG. 1 is a diagrammatic perspective view of the instant invention attached to the interior surface of a baseball shoe.
Figure 2:
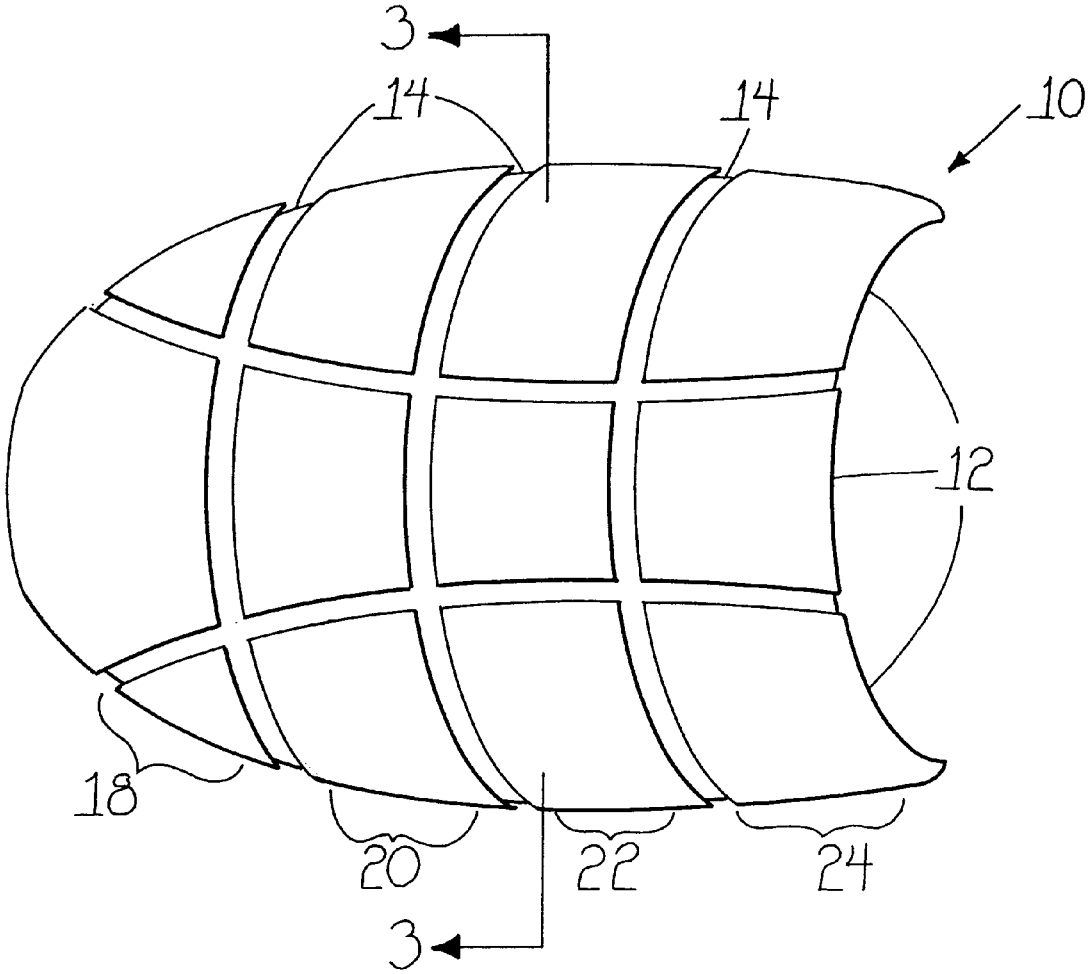
FIG. 2 is a top plan view of the instant invention, illustrating a plurality of rigid protective shell members joined by bendable elements.

FIGS. 1 and 2 illustrate a preferred embodiment of a shock absorbing liner 10 in accordance with the present invention. As will be seen in following paragraphs, the shock absorbing liner 10 is designed to be worn inside a baseball shoe 70 to protect the wearer's foot against injury precipitated by foul tipped balls. For a better understanding of the present invention, a baseball shoe 70 is illustrated comprising an upper shoe body 72, laces 74 attached to the upper shoe body 72 for fastening the upper shoe body 72 around the wearer's foot, and a cleated sole 76 attached to the upper shoe body 72. The upper shoe body includes a lower toe portion 78, an upper toe portion 80, a middle upper foot portion 82, and an uppermost foot portion 84.

Figure 3:
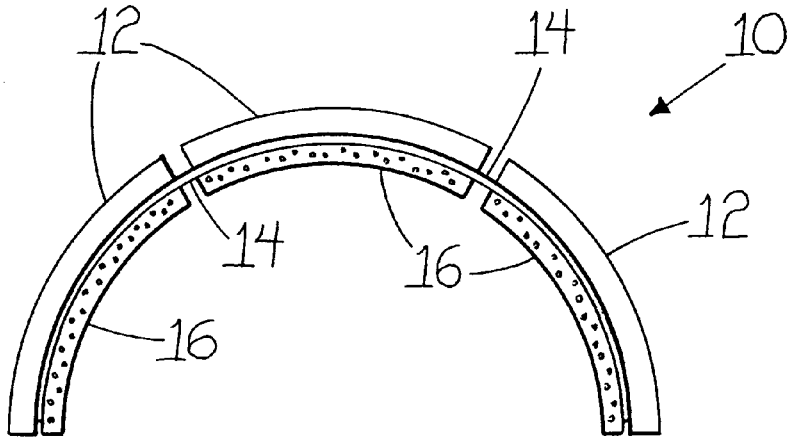
FIG. 3 is a cross-sectional view, taken on line 3—3 of FIG. 2 of the instant invention, illustration thin cushion members attached to the inside surface of the rigid protective shell members.

FIGS. 2 and 3 illustrate the shock absorbing liner 10 comprising a plurality of rigid protective shell members 12 held together by bendable elements 14 to afford foot protection without sacrificing free movement of the foot. Each rigid protective shell member 12 includes a thin cushion member 16 attached to the inside surface thereof for providing additional degree of protection as well as providing comfort for the wearer. The protective shell members 12 are preferably light in weight and possess sufficient shock absorbing capability to resist a wide range of dynamic impact forces that may be applied to the shoe 70 by a foul tipped ball striking the shoe 70. The protective shell members 12 can be constructed of a hard plastic material, or any other suitable material capable of resisting impact forces of anticipated magnitudes including metal, aluminum alloy, and the like.

Twelve protective shell members 12 are utilized in the preferred embodiment shown in FIGS. 1 and 2—lower toe protective shell members 18 to cover and extend about the lower toe region 78, upper toe protective shell members 20 to cover and extend about the upper toe region 80, middle upper foot protective shell members 22 to cover and extend about the middle upper foot region 82, and uppermost foot protective shell members 24 to cover and extend about the uppermost foot region 84. Each of the protective shell members 12 is shaped to conform to the corresponding interior portion of the upper shoe body 12 to which it is to be attached. Although in the preferred embodiment twelve shell member configuration is utilized, it should be noted that the shock absorbing liner 10 can utilize any other suitable configuration with different number of shell members 12 as long as it can bend along the appropriate points to allow substantially free movement of the foot and the shell members 12 collectively cover and protect essentially the entire upper foot region including the toes.

Figure 4:
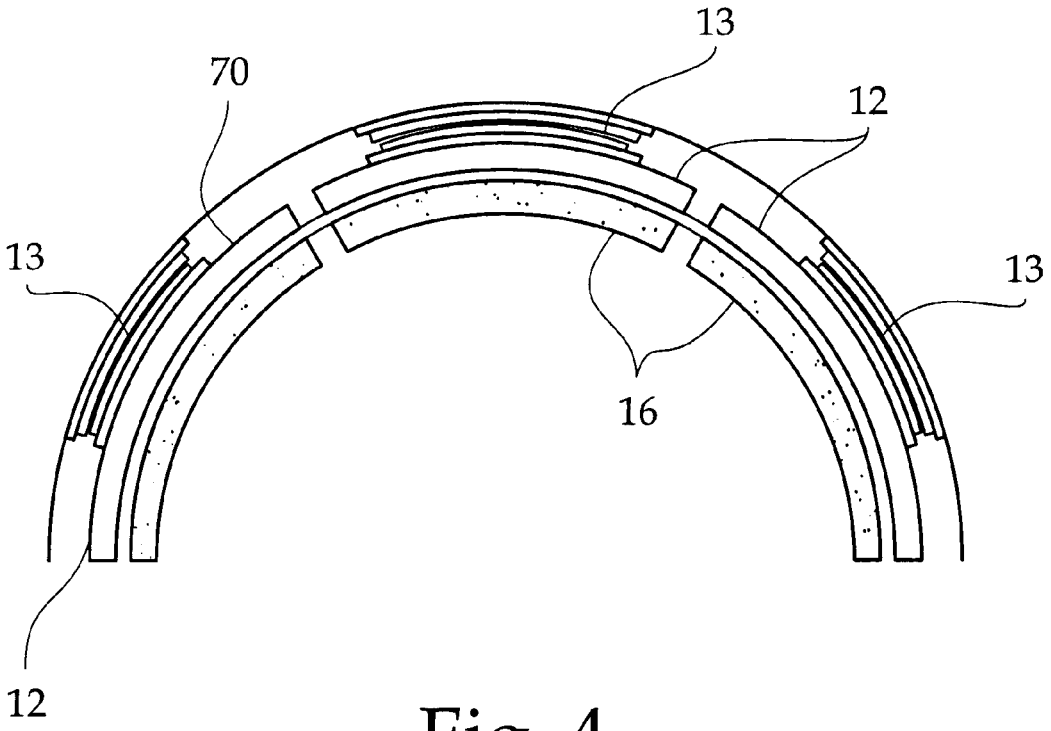
FIG. 4 is a cross sectional view of the instant invention attached to a baseball shoe, by means of a hook and loop fastening mechanism.

One important feature of the present invention is the ability of the shock absorbing liner 10 to flex with the baseball shoe 70. The bending of the shock absorbing liner 10 can be achieved by means of bendable elements 14 joining the shell members 12 together such that the shock absorbing liner 10 flexes inwardly to conform to the bending of the shoe 70. This permits the shock absorbing liner 10 to afford protection to the upper foot portion and toe portion without significantly restricting the normal movement of the foot. The shock absorbing liner 10 can be removably attached to the interior surface of the upper shoe body 72 by means of hook and loop fastening mechanism 13, as shown in FIG. 4, cooperatively arranged between the shock absorbing liner 10 and the interior surface of the shoe 70. Alternatively, the shock absorbing liner 10 may be permanently retained within the interior of the shoe 70 by means of adhesive or by any other fastening means as would be appreciated by those skilled in the art. Although the shock absorbing liner 10 is configured for easy adoption to existing baseball shoes, it should be noted that the shock absorbing liner 10 may be incorporated in newly manufactured baseball shoes as original equipment thereof. For instance, the shock absorbing liner 10 can be sewn or stitched to the interior surface of the upper shoe body during manufacturing.

To shield the foot against external impact forces, the wearer first insert his foot into the baseball shoe 70, and the laces 74 are used to achieve desired degree of tightness around the wearer's foot. When the shock absorbing liner 10 is properly situated between the upper shoe body 72 and the wearer's foot, the rigid protective shell members 12 cover and protect the toe and upper foot portion of the wearer's foot from externally impacting forces. Because the rigid protective shell members 12 are joined by a bendable material 14, the shock absorbing liner 10 will bend to conform to the wearer's foot. In this manner, the shock absorbing liner 10 protects the foot of a baseball player during batting from a foul tipped ball striking the foot, without significantly restricting the normal movement of the foot during base running.

While the embodiments of the present invention are disclosed in relation to a baseball shoe, it will be appreciated by those skilled in the art that the shock absorbing liner 10 disclosed herein may be utilized in connection with other types of athletic and non-athletic footwear requiring protection of the toe portion and upper foot portion of the wearer from externally impacting forces. Many specific details contained in the above description merely illustrate some preferred embodiments and should not be construed as a limitation on the scope of the invention. Many other variations are possible.

What is claimed is:

1. A shock absorbing liner for attaching to a baseball shoe to protect the toe and the upper foot portion of the wearer from externally impacting forces, said shoe having an interior toe portion and an interior upper foot portion, said shock absorbing liner comprising:

a) twelve protective shell members bendably attached to each other, said protective shell members constructed of material capable of resisting external impact forces, said protective shell members collectively cover and protect essentially the entire upper foot and toe portions of said baseball shoe with three lower toe protective shell members, three upper toe protective shell members, three middle upper foot protective shell members and three uppermost foot protective shell members, said protection members are configured to permit bending with respect to adjacent shell members to allow substantially free movement of the foot; and b) attachment means for attaching said protection members to said interior portions of the baseball shoe.

2. The shock absorbing liner as recited in claim 1, wherein the baseball shoe further comprises an interior lower toe portion, an interior upper toe portion, an interior middle upper foot portion, and an interior uppermost foot portion, and wherein the plurality of protection members further comprises a lower toe protection member shaped to conform to said interior lower toe portion of the shoe, a upper toe protection member shaped to conform to said interior upper toe portion of the shoe, a middle upper foot protection member shaped to conform to said interior middle upper foot portion of the shoe, and an uppermost foot protection member shaped to conform to said interior uppermost foot portion of the shoe.

3. The shock absorbing liner as recited in claim 2, wherein the protection members are constructed of a material capable of resisting impact forces that may be applied to the baseball shoe by a foul tipped ball striking the shoe.

4. The shock absorbing liner as recited in claim 3, wherein the protection members further comprise a cushion member attached to each of the protective members for providing additional protection and comfort.

5. The shock absorbing liner as recited in claim 4, wherein the attachment means comprises a hook and loop fastening mechanism cooperatively arranged between the protection members and the interior of the baseball shoe.

6. The shock absorbing liner as recited in claim 4, wherein the protective members are permanently incorporated in the baseball shoe.

* * * * *